United States Patent [19]

Yamaguchi et al.

[11] Patent Number: 4,792,140

[45] Date of Patent: Dec. 20, 1988

[54] IRON TYPE GOLF CLUB HEAD

[75] Inventors: Tetsuo Yamaguchi; Takeshi Iwanaga, both of Kobe, Japan

[73] Assignee: Sumitomo Rubber Industries, Ltd., Kobe, Japan

[21] Appl. No.: 593,837

[22] Filed: Mar. 27, 1984

[30] Foreign Application Priority Data

Mar. 28, 1983 [JP] Japan ..... 58-53338
Mar. 28, 1983 [JP] Japan ..... 58-53339

[51] Int. Cl.[4] ..... A63B 53/04
[52] U.S. Cl. ..... 273/173; 273/78; 273/DIG. 1; 273/DIG. 22; 273/DIG. 10
[58] Field of Search ..... 273/78, 173, DIG. 1, 273/DIG. 22, DIG. 23, DIG. 10

[56] References Cited

U.S. PATENT DOCUMENTS

| | | | |
|---|---|---|---|
| 1,289,553 | 12/1918 | Sanders | 273/173 |
| 3,218,072 | 11/1965 | Burr | 273/78 |
| 3,233,905 | 2/1966 | Flom | 273/173 |
| 4,181,306 | 1/1980 | Jepson | 273/173 |

FOREIGN PATENT DOCUMENTS

| | | | |
|---|---|---|---|
| 1227948 | 4/1971 | United Kingdom | 273/173 |

*Primary Examiner*—William H. Grieb
*Attorney, Agent, or Firm*—Birch, Stewart, Kolasch & Birch

[57] ABSTRACT

An iron type golf club head having the whole or the central part of a ball striking face thereof, which directly touches a golf ball, fabricated from a material possessing a compression Young's modulus (modules of longitudinal elasticity) lower than that of steel.

20 Claims, 4 Drawing Sheets

IRON TYPE GOLF CLUB HEAD

BACKGROUND AND SUMMARY OF THE INVENTION

This invention relates to iron type golf club heads, and particularly to golf ball striking faces of iron type golf clubs.

Various kinds of materials have previously been used for wood type golf clubs. For example, as disclosed in U.S. Pat. No. 4,181,306 to Jepson, many kinds of materials such as wood, metal, synthetic resinous and other materials have been used.

However, the entire body of an iron type golf club head has been fabricated from only metal such as mild steel or stainless steel, and, accordingly, a ball striking face thereof to be in direct contact with a golf ball has also been fabricated from hard metal.

Such conventional iron type golf club heads, however, have reached the upper limit of increase in the carry of golf ball. Moreover, with the recent prevalence of two-component type golf balls among golfers, a problem has been that control over the direction and distance travelled by the golf ball is difficult because a hard feeling is impressed to golfer's hands in a far shorter period of time spent while the two-component type golf ball is in contact with the striking face than that in the case of the conventional thread-wound type golf ball.

Accordingly, an object of this invention is to provide an iron type golf club head to increase the carry of golf balls.

Another object of this invention is to provide an iron type golf club head to reduce the degree of back spin and increase the trajectory angle of impacted golf ball.

Still another object of this invention is to provide an iron type golf club head to prolong the period of time to be spent while the two-component type or one-component type golf ball is in contact with the striking face of the golf club head (that is, to increase the rate of contact time assumed as 100 to 105–130), thereby enabling easier control over the travelling direction of golf ball and improved feeling to golfer's hands at a moment of hitting the golf ball.

Other objects, features, and advantages of this invention will become apparent upon reference to the appended drawings and detailed description that will be made later.

According to this invention, there is provided a golf club head comprising a head proper made of metal and a member occupying at least the central part of the golf ball striking face and made of a material having a compression Young's modulus lower than that of steel.

In addition, according to this invention, there is provided a golf club head comprising a metallic head proper and a member occupying at least the central part of the golf ball striking face, made of a material having a compression Young's modulus lower than that of steel, and formed to be flat and smooth with none of face grooves.

Furthermore, according to this invention, there is provided a golf club head wholly fabricated from only a member made of a material having a compression Young's modulus lower than that of steel.

DESCRIPTION OF THE PREFERRED EMBODIMENTS

Figure 1:
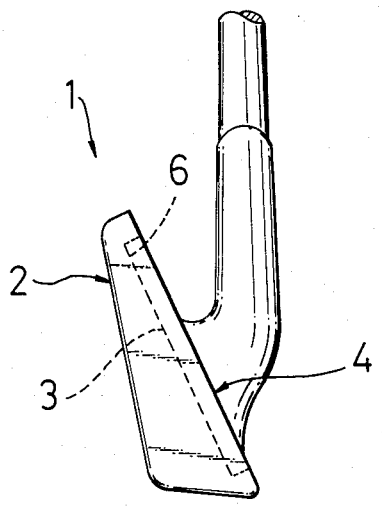
FIG. 1 is a side view of an embodiment of this invention.

A detailed description of the drawings will be made. In the embodiments shown in FIGS. 1, 2, and 3, an iron type golf club head 1 comprises a head proper 2 made of metal such as mild steel or stainless steel and a member 3 made of a material lower in compression Young's modulus as compared with steel. Concretely speaking, the metallic head proper 2 is provided with a recess 6 shaped like a shallow saucer extended over the inner part of the striking face 4 except the peripheral part 5 thereof. These drawings show that the abovesaid member 3 is a plate-like insert. The thickness of this plate-like member 3 as an insert is determined to be equal to the depth of the recess 6 of the head proper 2 and contour of the abovesaid member 3 is adapted to be the same as that of the recess 6 of the head proper 2. Such a member 3 as above is fixedly embedded into the abovesaid recess 6.

Figure 2:
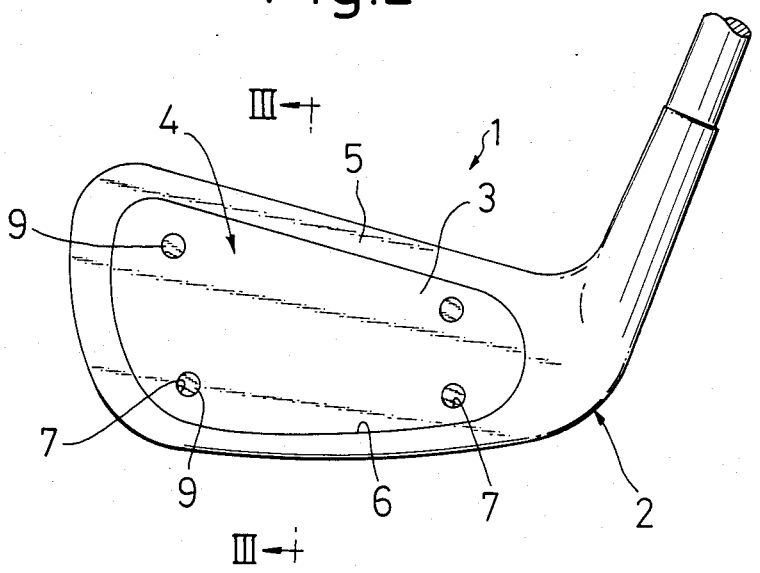
FIG. 2 is a front elevational view thereof.
Figure 3:
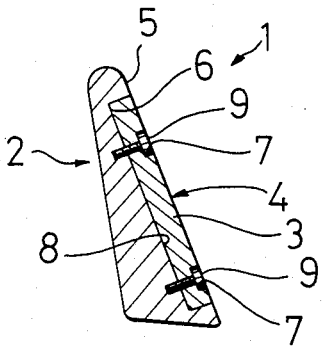
FIG. 3 is a sectional view thereof taken along the line III—III in FIG. 2.

In the embodiments shown in FIG. 2 and FIG. 3, four stepped holes 7 . . . are drilled beforehand on the member 3 which is an insert, and screw holes are provided in positions corresponding to the abovesaid stepped holes 7 . . . on the bottom surface 8 of the recess 6. Fixing means 9 . . . such as screws are inserted through the abovesaid holes 7 . . . and screwed into the abovesaid screw holes on the bottom surface 8, whereby the member 3 as an insert is fixedly embedded into the recess 6. Application of adhesive in addition to the use of fixing means is preferable. Fixation of the member 3 to the recess 6 of the head proper 2 by only application of adhesive without the use of fixing means 9 . . . is also preferable.

In this way, the member 3 made of a material having a compression Young's modulus lower than that of steel occupies at least the central part of the striking face 4 of the golf club head 1. Accordingly, the rate of area of the member 3 against the total area of the striking face 4 as shown in FIG. 2 is optionally changeable smaller or larger than shown hereat.

A material used for the abovesaid member 3 is such that the compression Young's modulus thereof is sufficiently lower than that (21,000 kg/mm$^2$) of steel that has been used in the conventional iron type golf club head. For example, synthetic resin or other various kinds of composite materials having a compression Young's modulus of 0.3 to 5,000 kg/mm$^2$ are used.

Among particularly preferable materials for the member 3, included are ABS, ionomer, and polycarbonate resins whose compression Young's modulus ranging from 30 to 2,000 kg/mm$^2$.

As shown in FIG. 2, a plurality of face grooves lined horizontally and parallelly on the conventional type striking face are completely omitted on the striking face 4 of a golf club head according to this invention. That is, the member 3 is completely devoid of face grooves throughout and formed to have a flat smooth surface. The peripheral part of the striking face of the head proper 2 is also completely not provided with lined face grooves.

Figure 4:
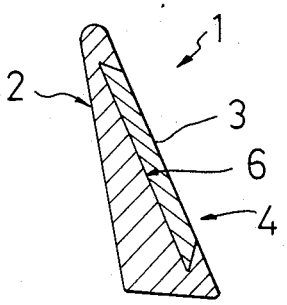
FIG. 4 is a sectional view showing another embodiment of this invention.

As shown in FIG. 4 which is a sectional view substituted for FIG. 3 and shows another embodiment of this invention, a recess 6 of the head proper 2 is cross-sectionally enlarged toward the innermost part so as to intensify sticking of the member 3 to be fixedly embedded into the recess 6. In other words, inner side surfaces of the recess 6 are tapered for enlargement of the innermost part thereof.

For the embodiment shown in FIG. 4, additional use of fixing means 9 . . . similar to those as shown in FIG. 3 is preferable or application of adhesive on appropriate occasion is also preferable.

FIG. 5, FIG. 6, FIG. 7, FIG. 8, and FIG. 9 substituted for FIG. 2 show other embodiments different from each other.

Figure 5:
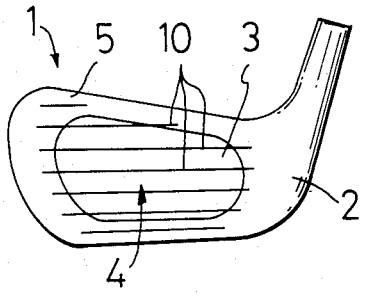
FIGS. 5 to 9 are front elevational views showing a number of other embodiments.

In the embodiment shown in FIG. 5, a plurality of parallelly lined face grooves 10 . . . are formed on the entire surface of the member 3 and the peripheral part 5 of the striking face 4 of the head proper 2.

Figure 6:
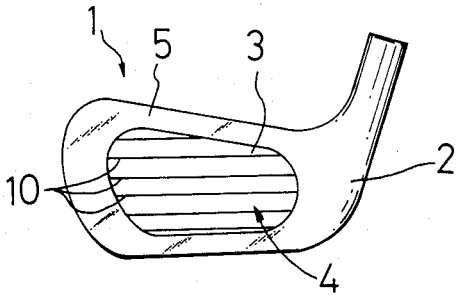

In FIG. 6, a plurality of parallelly lined face grooves 10 . . . are formed on only the entire surface of the member 3 . . . .

Figure 7:
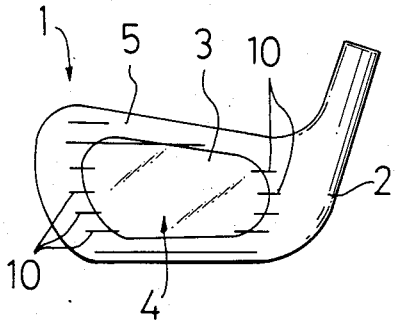

In FIG. 7, a plurality of parallelly lined face grooves 10 . . . are formed on the outer periphery of the member 3 and the peripheral part 5 of the striking face 4 of the head proper 2. Therefore, lined face grooves 10 . . . are formed on only the periphery of the striking face 4 and not formed on the central part at which direct contact of the striking face with the golf ball occurs in high probability at the time of ball hitting, thereby the striking face 4 being flat and smooth.

Figure 8:
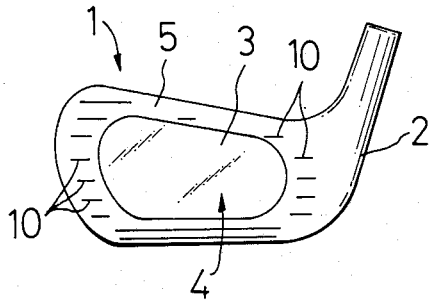

In FIG. 8, face grooves 10 . . . are completely omitted on the member 3 and formed on only the peripheral part 5 of the striking face 4 of the head proper 2. Complete omission of face grooves on the central part of the striking face 4 at which direct contact of the golf ball therewith occurs in high probability when the ball is hit is similar to the case shown in FIG. 7.

Figure 9:
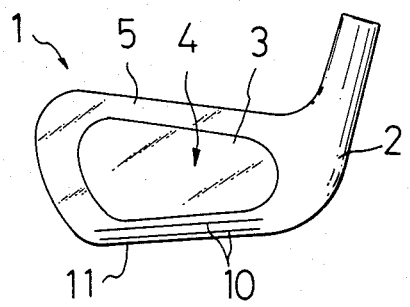

In FIG. 9, the lower part of the striking face 4, that is, the sole side 11, is provided with two lines of face grooves 10 and 10 and the other part is a flat smooth surface devoid of face grooves.

Figure 10:
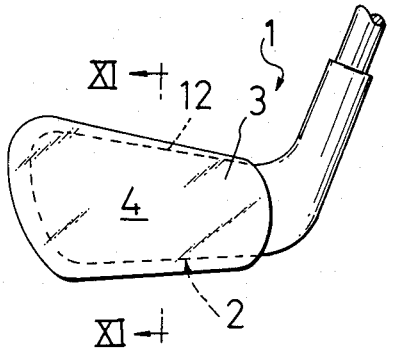
FIG. 10 is a front elevational view of still another embodiment.
Figure 11:
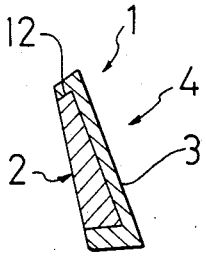
FIG. 11 is a sectional view thereof taken along the line XI—XI in FIG. 10.

In the other embodiment shown in FIG. 10 and FIG. 11, the approximate whole of the striking face of a metallic head proper 2 is covered with a member 3 made of a material having a compression Young's modulus lower than that of steel. Further, in this embodiment, a part of the outer peripheral surface 12 of the head proper 2 is covered with such member 3 as above.

Thus, the approximate whole of the striking face 4 is occupied by the member 3, and, as apparent from FIG. 10, the striking face 4 is formed to be smooth and flat without face grooves. A value of compression Young's modulus and the kind of material of the abovesaid member 3 are identical to those of other embodiments previously described.

Figure 12:
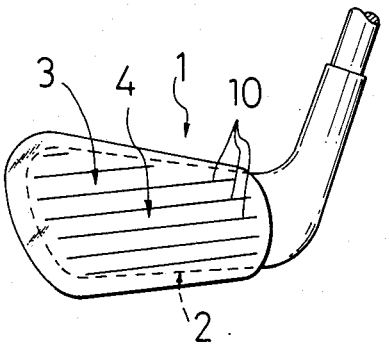
FIG. 12, FIG. 13, and FIG. 14 are front elevational views showing a number of other embodiments.
Figure 13:
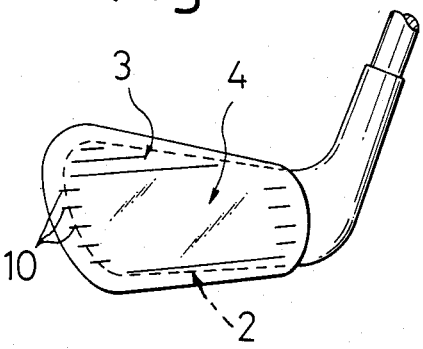
Figure 14:
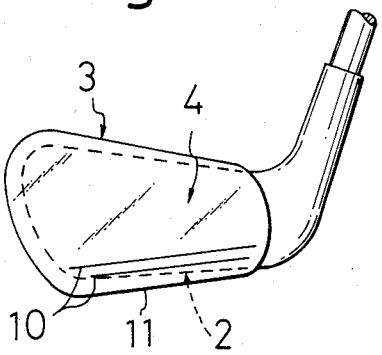

FIG. 12, FIG. 13, and FIG. 14 are substituted for FIG. 10 and show other embodiments different from each other.

In FIG. 12, horizontally and parallelly lined face grooves 10 . . . are formed on the approximate whole of the member 3 composing the striking face 4.

In FIG. 13, face grooves are omitted on the part near the center of the member 3, that is, the part at which contact of the golf ball with the striking face occurs in high probability at the time of hitting the ball, so that the striking face 4 is formed to be flat and smooth. Face grooves 10 . . . are formed on the peripheral part except that part near the center of the member 3.

In FIG. 14, the lower part of the striking face 4, that is, the sole side 11, is provided with two lines of face grooves 10 and 10 and other parts are flat and smooth wighout face grooves. Though not illustrated, to provide a reduced or increased number of lines of face grooves 10 and 10, i.e., one line or three lines, is preferable.

Figure 15:
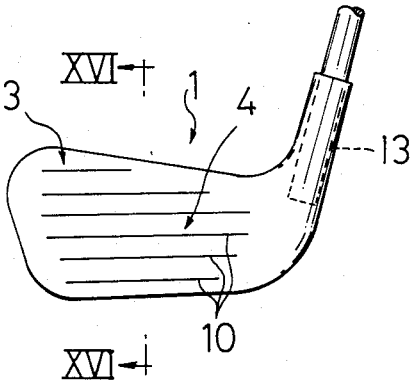
FIG. 15 is a front elevational view of a further embodiment.
Figure 16:
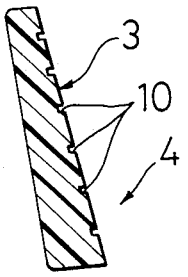
FIG. 16 is an enlarged sectional view thereof taken along the line XVI—XVI in FIG. 15.

FIG. 15 and FIG. 16 show further embodiments, in which the entire body of the head is fabricated from only the abovesaid member 3 made of a material having compression Young's modulus lower than that of steel. The reference numeral 13 indicates the lower end of the shaft of golf club inserted into and fixed to the head 1 of golf club fabricated from only the member 3 as described above.

The member 3 as above desirably possesses a compression Young's modulus ranging from 30 to 2,000 kg/mm$^2$ and is preferably made of synthetic resin such as ABS, ionomer, or polycarbonate ones. The approximate whole of the striking face 4 is provided with lined face grooves 10 . . . in the same manner as conventional.

Figure 17:
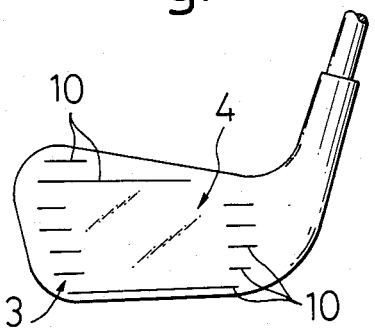
FIG. 17, FIG. 18, and FIG. 19 are front elevational views showing a number of other embodiments of this invention.
Figure 18:
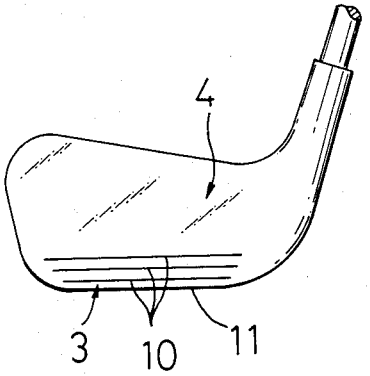
Figure 19:
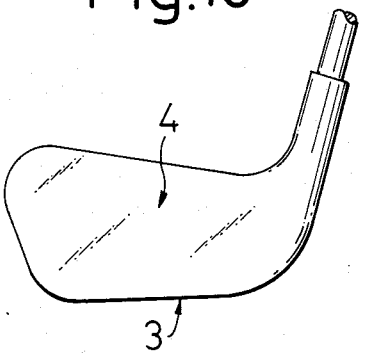

FIG. 17, FIG. 18, and FIG. 19 are substituted for FIG. 15 and show other embodiments different form each other.

In FIG. 17, face grooves 10 . . . are formed on only the peripheral part of the striking face 4 and not on the central part at which contact of the golf ball with the striking face occurs in high probability at the time of hitting the ball.

In FIG. 18, three lines of face grooves 10, 10, and 10 are formed on the lower part of the striking face 4, that is, the sole side 11. Though not illustrated, the number of lines of face grooves 10 . . . is preferably reduced to two or one.

In FIG. 19, the striking face 4 is provided with none of face grooves and formed to be flat and smooth.

In any of embodiments shown in FIG. 17, 18, and 19, the entire body of golf club head 1 is fabricated from a material having a compression Young's modulus lower than that of steel as described above, for example, synthetic resin whose compression Young's modulus ranges from 30 to 2,000 kg/mm$^2$.

A small number of face grooves 10 . . . ranging from one to three formed on the lower side of the striking face 4, as seen in the embodiments shown in FIG. 9, FIG. 14, and FIG. 18 among those described above, conveniently serves as a standard for directioning the striking face in addressing a golf ball.

Results of measurements with respect to the embodiments of this invention will be presented as follows:

Comparison of golf club heads, which were fabricated from such members 3 as made of ABS and ionomer resins having compression Young's moduli of 250 and 200 kg/mm$^2$, respectively, each fixed to a part of the striking face as an insert, with a conventional type golf club head (fabricated from metal, provided with face grooves, and having a compression Young's modulus of 21,000 kg/mm$^2$ as a whole) was made with respect to the trajectory angle, carry, and degree of spin of the golf ball. Results are shown in Table 1, Table 2, and Table 3. Two-component type golf balls were used and, as regards the type number of golf clubs, No. 5, No. 7, and No. 9 correspond to Table 1, Table 2, and Table 3, respectively.

TABLE 1

| Kind of club head | (No. 5 iron) Trajectory angle (degree) | Carry (m) | Degree of spin (R.P.M.) |
|---|---|---|---|
| Conventional, steel (with face grooves) | 15.3 | 162.3 | 4,955 |
| ABS resin (without face grooves) | 17.4 | 170.8 | 2,645 |
| Ionomer resin (without face grooves) | 16.3 | 169.9 | 2,700 |

TABLE 2

| Kind of club head | (No. 7 iron) Trajectory angle (degree) | Carry (m) | Degree of spin (R.P.M.) |
|---|---|---|---|
| Conventional, steel (with face grooves) | 18.5 | 138.8 | 6,573 |
| ABS resin (without face grooves) | 20.9 | 159.0 | 2,030 |
| Ionomer resin (without face grooves) | 20.6 | 159.5 | 2,538 |

TABLE 3

| Kind of club head | (No. 9 iron) Trajectory angle (degree) | Carry (m) | Degree of spin (R.P.M.) |
|---|---|---|---|
| Conventional, steel (with face grooves) | 20.8 | 115.0 | 8,113 |
| ABS resin (without face grooves) | 29.8 | 139.4 | 1,845 |
| Ionomer resin (without face grooves) | 28.1 | 139.8 | 2,697 |

From Tables 1, 2, and 3, it is clearly known that striking faces fabricated from a material as ABS or ionomer resin and provided without face grooves serve to increase the trajectory angle, reduce the degree of spin, and increase the carry of ball more than the conventional type striking face.

Similarly, even such striking faces as provided with none of face grooves apparently showed favorable results.

This invention can be embodies in other ways without departing from the spirit and essential features thereof. Accordingly, embodiments described herein are exemplary and do not limit this invention.

We claim:

1. An iron type golf club head, comprising: a head proper made of metal; and a member fabricated from a resin material which possesses a compression Young's modulus value lower than that of steel, and occupying at least the central part of a golf ball striking face of said head wherein said ball striking face of said member is not provided with face grooves and is formed to be flat and smooth.

2. An iron type golf club head as set forth in claim 1, wherein a value of compression Young's modulus of said member lower than that of steel falls within a range from 0.3 to 5,000 kg/mm$^2$.

3. An iron type golf club head as set forth in claim 1, wherein said metallic head proper is provided with a shallow recess at the inner part of said golf ball striking face thereof except the peripheral part and with a member having a compression Young's modulus lower than that of steel and serving as an insert to be fixedly embedded into said recess.

4. An iron type golf club head as set forth in claim 3, wherein one through three lines of face grooves are formed on the lower part, near the sole side, of the periphery of the golf ball striking face of said metallic head proper.

5. An iron type golf club head as set forth in claim 1, wherein a member having a compression Young's modulus value lower than that of steel covers approximately whole of said golf ball striking face of said metallic head proper.

6. An iron type golf club head as set forth in claim 1, wherein a value of compression Young's modulus of said member lower than that of steel falls within a range from 0.3 to 5,000 kg/mm$^2$.

7. An iron type golf club head as set forth in claim 6, wherein the compression Young's modulus value of said member falls within a range from 30 to 2,000 kg/mm$^2$.

8. An iron type golf club head as set forth in claim 7, wherein said member having a compression Young's modulus lower than that of steel is made of synthetic resin.

9. An iron type golf club head as set forth in claim 1, wherein the whole of the striking face is fabricated from only a member made of a material having a compression Young's modulus lower than that of steel and being flat and smooth without face grooves.

10. An iron type golf glub head as set forth in claim 1, wherein lined face grooves are formed on only the peripheral part of said striking face and are not formed on the central part of said striking face.

11. An iron type golf club head as set forth in claim 1, wherein one through three lines of face grooves are formed on the lower part of the striking face and not formed on other parts of said striking face.

12. The iron type golf club as set forth in claim 1, wherein the resin material is selected from the group consisting of ABS, ionomer, and polycarbonate resins.

13. The iron type golf club as set forth in claim 1, wherein the compression Young's modulus value of said resin material is between 200 and 250 kg/mm$^2$.

14. An iron type golf club head, comprising: a head proper made of metal; and a member formed from a synthetic resin material having a compression Young's modulus value of from 30 to 2,000 kg/mm$^2$, said member occupying a major portion of the golf ball striking face of said head and said member forming a striking face which is not provided with face grooves and which is smooth and flat over a major portion of said striking face.

15. An iron type golf club head as set forth in claim 14, wherein the compression Young's modulus value of said synthetic resin material is about 200 to 250 kg/mm$^2$.

16. An iron type golf club as set forth in claim 14, wherein said synthetic resin material is an ABS resin.

17. An iron type golf club as set forth in claim 14, wherein said synthetic resin is an ionomer resin.

18. An iron type golf club as set forth in claim 14, wherein said synthetic resin is a polycarbonate resin.

19. An iron type golf club head, comprising: a head proper made of metal, said head proper having a shallow recess covering a major porton of the golf ball striking face of said head proper; and an insert made of a synthetic resin material having a compression Young's modulus value of from 30 to 2,000 kg/mm$^2$ located in said recess, said insert having a smooth and flat golf ball striking surface.

20. An iron type golf club head as set forth in claim 19, wherein the compression Young's modulus value of said synthetic resin is from 200 to 250 kg/mm$^2$.

* * * * *